US006474396B1

(12) United States Patent
Toder

(10) Patent No.: US 6,474,396 B1
(45) Date of Patent: Nov. 5, 2002

(54) KNITTED MESH WITH RELIEF BAND AND METHOD

(76) Inventor: Ellis I. Toder, 2000 Pioneer Rd., Huntingdon Valley, PA (US) 19006

( * ) Notice: Subject to any disclaimer, the term of this patent is extended or adjusted under 35 U.S.C. 154(b) by 0 days.

(21) Appl. No.: 09/928,068

(22) Filed: Aug. 13, 2001

(51) Int. Cl.[7] ..... A47H 23/00
(52) U.S. Cl. ..... 160/237; 160/DIG. 7
(58) Field of Search ..... 160/237, 330, 160/123, 124, DIG. 6, DIG. 7, 405

(56) References Cited

U.S. PATENT DOCUMENTS

| | | | | | |
|---|---|---|---|---|---|
| 2,037,629 | A | * | 4/1936 | Holgate | 160/237 |
| 3,035,275 | A | * | 5/1962 | Strebeigh | 160/237 |
| 3,321,003 | A | * | 5/1967 | Boerner | 160/237 |
| 4,377,195 | A | * | 3/1983 | Weil | 160/237 |
| 5,351,739 | A | * | 10/1994 | Levy | 160/124 |

* cited by examiner

*Primary Examiner*—David M. Purol
(74) *Attorney, Agent, or Firm*—Paul Maleson

(57) ABSTRACT

An open mesh is adapted for use as the upper portion of a cubicle curtain. The open mesh has a major portion with openings, and a narrow and a wide selvedge. The open mesh major portion has said integral narrow knitted selvedge on an edge opposed to said integral wide knitted selvedge. The selvedges have a substantially finer mesh than the open mesh major portion. The open mesh is knitted in multiple adjoining panels. Adjoining panels are connected with in order a first narrow selvedge, an intermediate strip comprising a tear thread, a waste strip and an open mesh relief band, and a second narrow selvedge. The selvedges are thus made integral with the major open cell portion and are ready without further manufacturing steps (except for separating from a roll and for sizing) for the insertion of grommets in the wide selvedge and the sewing to a vision-resistant fabric at the narrow selvedge with the narrow selvedge retaining a straight outer edge due to use of the relief band during sizing on a pin frame.

18 Claims, 4 Drawing Sheets

FIG. 1
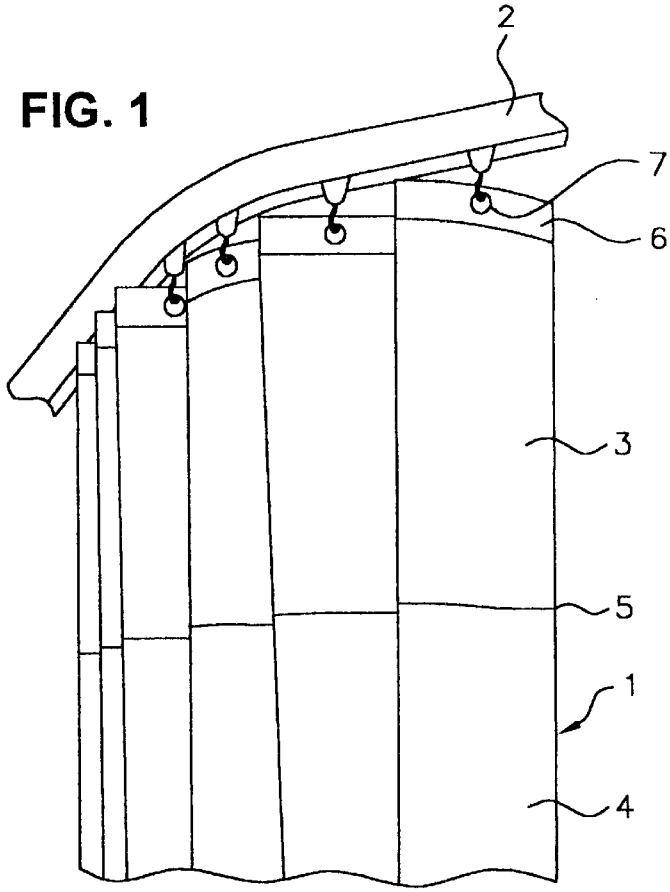
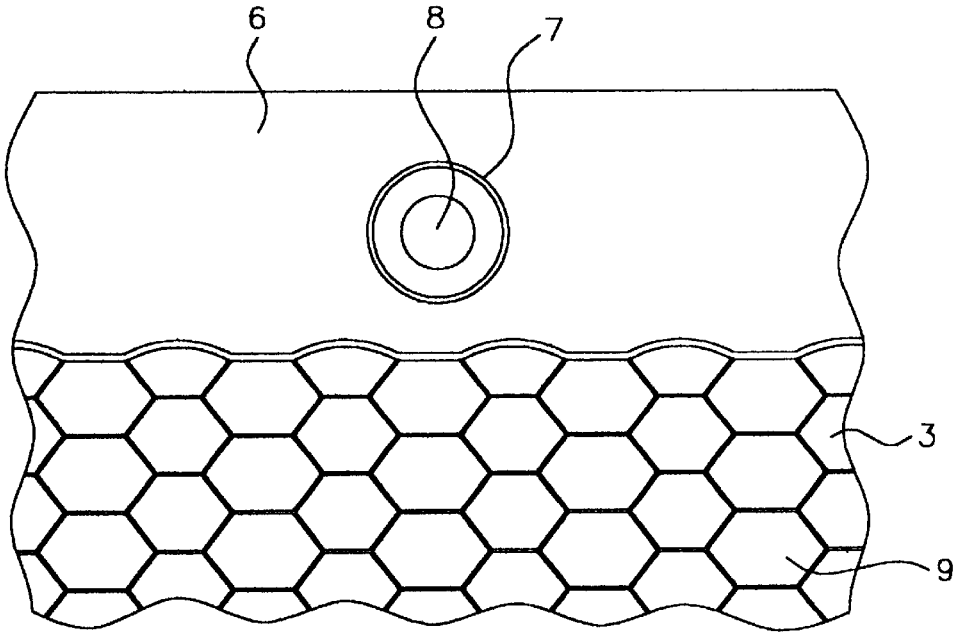
FIG. 2

FIG. 5
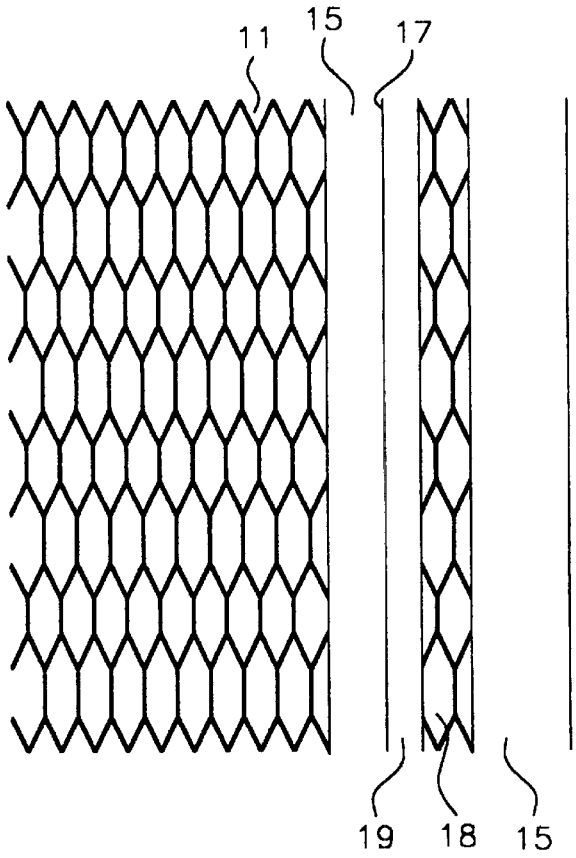
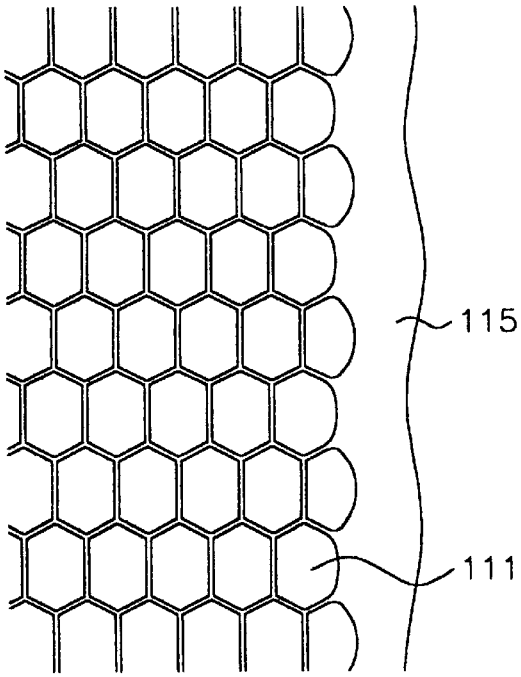
FIG. 6
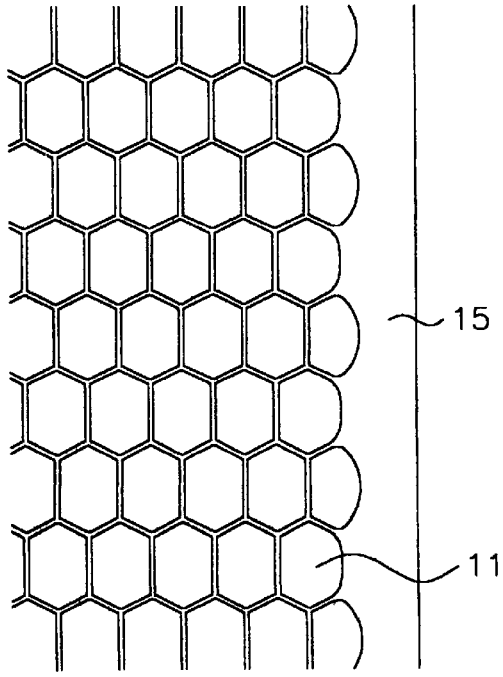
FIG. 7

KNITTED MESH WITH RELIEF BAND AND METHOD

BACKGROUND OF THE INVENTION

1. Field of the Invention

This invention relates to the top section of cubicle curtains. Cubicle curtains are most often used in hospital or other medical settings in which it is desired to have privacy around the bed of a patient. Such cubicle curtains are generally capable of being opened or closed and movable, as on hangers, so that they can be opened or closed as desired.

Generally, the major portion of a cubicle curtain is opaque, translucent, or, as a general term, vision-resistant. Its purpose is to provide privacy for the patient. Approximately generally 20" of the top is made of an open mesh. This open mesh vertical dimension may also typically be between 12" and 40", although the exact dimensions are not critical.

The purpose of the open mesh area is primarily for permitting effective operation of fire sprinklers. It also permits circulation of the air and the passage of light. The open mesh does not damage the privacy of the patient because it is too high for the eye of the usual person to peer over.

The more specific field of the present invention relates to the lower or narrow selvedge of the open mesh portion. The lower selvedge is attached to the vision-resistant portion of a cubicle curtain. In the present invention, a relief strip is incorporated in the knitting process which permits the outer edge of the narrow selvedge to have a desirable straight edge.

In addition, this invention relates to the process or method by which the open mesh portion of the cubicle curtain is made.

It relates to the provision of a lower narrower selvedge to which the vision-resistant main portion of the cubicle curtain is fastened. The upper selvedge is provided with grommets to in turn provide for hanging the cubicle curtain.

2. Prior Art

The conventional structure and method of construction of a grommet-receiving selvedge on a cubicle curtain open mesh has been to provide a separately manufactured strip or band of relatively closely woven material. The edge of the open mesh portion is folded over this independent edge band and is fastened to it by sewing, heat welding or other means. Then, grommets are inserted through the selvedge thus created. To the extent that the prior art may include integral knitting of open and closed mesh portions, the prior art has produced narrow selvedges with deformed outer edges affixed to the vision-resistant portion of the cubicle curtain.

SUMMARY OF THE INVENTION

An open mesh is adapted for use as the upper portion of a cubicle curtain. The open mesh has a major portion with openings, and has an integral knitted upper wide selvedge on one edge thereof. The knitted wide selvedge has a substantially finer or closer mesh than the open mesh major portion. The open mesh major portion also has an integral narrow knitted selvedge on an edge opposed to the wide selvedge, affixed to the vision-resistant portion of the cubicle curtain. The narrow selvedge also has a substantially finer or closer mesh than the open mesh major portion. The narrow selvedge in the present invention has a desirable straight outer edge, due to a multiple panel width being knitted with a relief band adjacent to the narrow selvedge.

The selvedges are thus made integral with the major open cell portion and are ready without further manufacturing steps (except for separating from a roll and for sizing) for the insertion of grommets in the wide selvedge and the sewing to a vision-resistant fabric at the narrow selvedge.

With the present invention, there is no requirement of sewing and turning of a raw edge at the top. Framing and stiffening tape are no longer required. It is merely necessary during the manufacturing step to apply the grommets in a conventional manner. In the present invention, since the selvedge is knitted, there is easier sewing or other fastening means at the other edge, which is to be attached to the vision-resistant main portion. In particular, the outer edge of the narrow selvedge, attached to the vision-resistant portion of the cubicle curtain, has a straight edge, due to the inclusion of a relief band in the knitting process. There is no puckering or raw edges and no working loss. There are firmer headings without sag. In addition, the grommets have been found to grip tighter.

Since there is no necessity for turning up the open portion around an independent band, there is a saving of that amount of material, which may be up to 3". This provides an additional cost saving.

BRIEF DESCRIPTION OF THE DRAWINGS

FIG. 1 is an elevational view of a cubicle curtain in its hung operative position, showing it withdrawn and accordion folded into a partially open position;

FIG. 2 is an elevational view of part of the open mesh portion of the cubicle curtain with its integral knitted wide selvedge.

FIG. 5 is a detailed view of the narrow selvedge and the intermediate strip before separation.

FIG. 6 is a detailed view of prior art narrow selvedge before affixing to the vision-resistant portion of the cubicle curtain.

FIG. 7 is a detailed view of the present invention's narrow selvedge before affixing to the vision-resistant portion of the cubicle curtain.

DESCRIPTION OF THE PREFERRED EMBODIMENT

Figure 3:
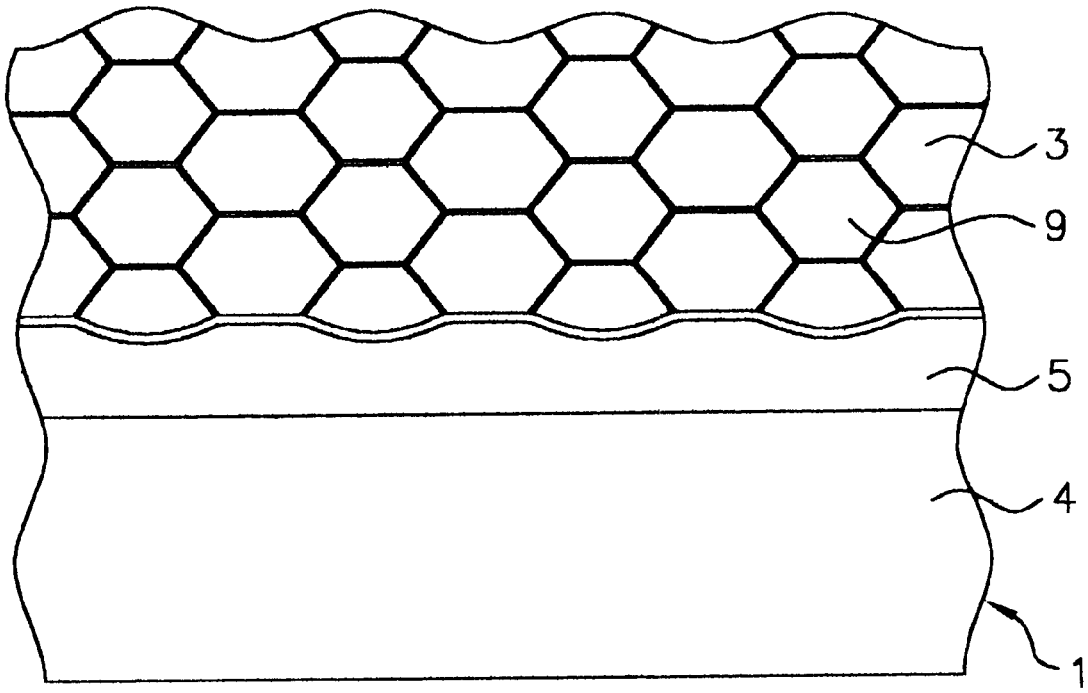
FIG. 3 is an elevational view of a portion of the cubicle curtain, showing the vision-resistant portion attached to the open mesh portion by means of the narrow selvedge which is an integral part of the open mesh portion.

In the present invention, the open mesh portion is knitted with a thread of combined monofilaments, preferably but not limited to nylon. At one edge, the open mesh portion is provided with a wide selvedge of approximately 1–1½" of a much closer mesh knit, and the other edge is provided with a narrow selvedge with an approximately ½ close knit mesh. The selvedges are knitted integrally with the open mesh portion. Thus, there is an automatic provision of a knitted selvedge on each edge (the upper and lower edges as the product is hung).

As a practical matter, the knitting machine produces wider rolls with multiple panels of open mesh, in which edges of adjoining pieces are selvedges, and these selvedges are connected to the adjacent panels by pull or tear threads, so that the panels can be separated into individual useful pieces.

Thus, there is no necessity of the manufacturing step and the use of additional material, as described elsewhere herein as a matter of prior art, to produce the selvedge which will contain the grommets. The holes and the grommets may be punched and inserted directly into the wide close knitted band selvedge.

FIG. 1 discloses a cubicle curtain hung in its operative position, showing it withdrawn and accordion folded into a partially opened position elevational view of a cubicle curtain in its hung operative position. A cubicle curtain generally designated 1 is provided with a main lower portion 4, which is a vision-resistant portion. It may be made of any type of fabric, produced in any manner, with any degree of opacity or translucency as required. The structure of the main vision-resistant portion is not in itself part of this invention.

The upper portion, which is generally about 20" in vertical dimension, but may be between 12" and 40", without any criticality in the dimension, is generally of an open mesh construction. As explained, this permits the effective operation of fire sprinklers, circulation of air, and the passage of light. Preferably, the upper edge of the vision-resistant portion 4 is high enough so that a normally expected viewer cannot appear over the top and see the patient, thus intruding on the patient's privacy.

The open mesh 3 is provided with a narrow selvedge 5, which is hardly visible in FIG. 1. The main portion 4 is attached to the narrow selvedge 5 by any convenient means, as by sewing or heat welding or otherwise in any known or conventional manner.

The upper edge of the open mesh 3 is provided with a wide selvedge 6. This selvedge is explained in further detail below. Grommets 7 are provided at spaced intervals through the wide selvedge 6. Any appropriate suspension means 2 is provided to support the cubicle curtain 1 by means of a grommet 7.

FIG. 2 is an elevation view of part of the open mesh 3 with its integrally knitted wide selvedge 6. A grommet 7 with a grommet hole 8 is shown in position through the wide selvedge 6. The open mesh 3 is provided with a plurality of openings 9. The structural details of all these elements are described with more particularity below.

FIG. 3 is a view of part of the cubicle curtain 1, showing the knitted open mesh 3 with its openings 9, together with its integrally knitted narrow selvedge 5, having a much tighter mesh. The vision-resistant portion 4 is attached to the narrow selvedge by any conventional means, as by sewing, heat welding, mechanical fastening or any other known or conventional means. The vision-resistant 4 is made of any fabric appropriate to the purpose. It may have varying degrees of opacity, translucency, or vision-resistance. It may be woven, knitted, or what is known as a non-woven fabric, or may be vinyl.

Figure 4:
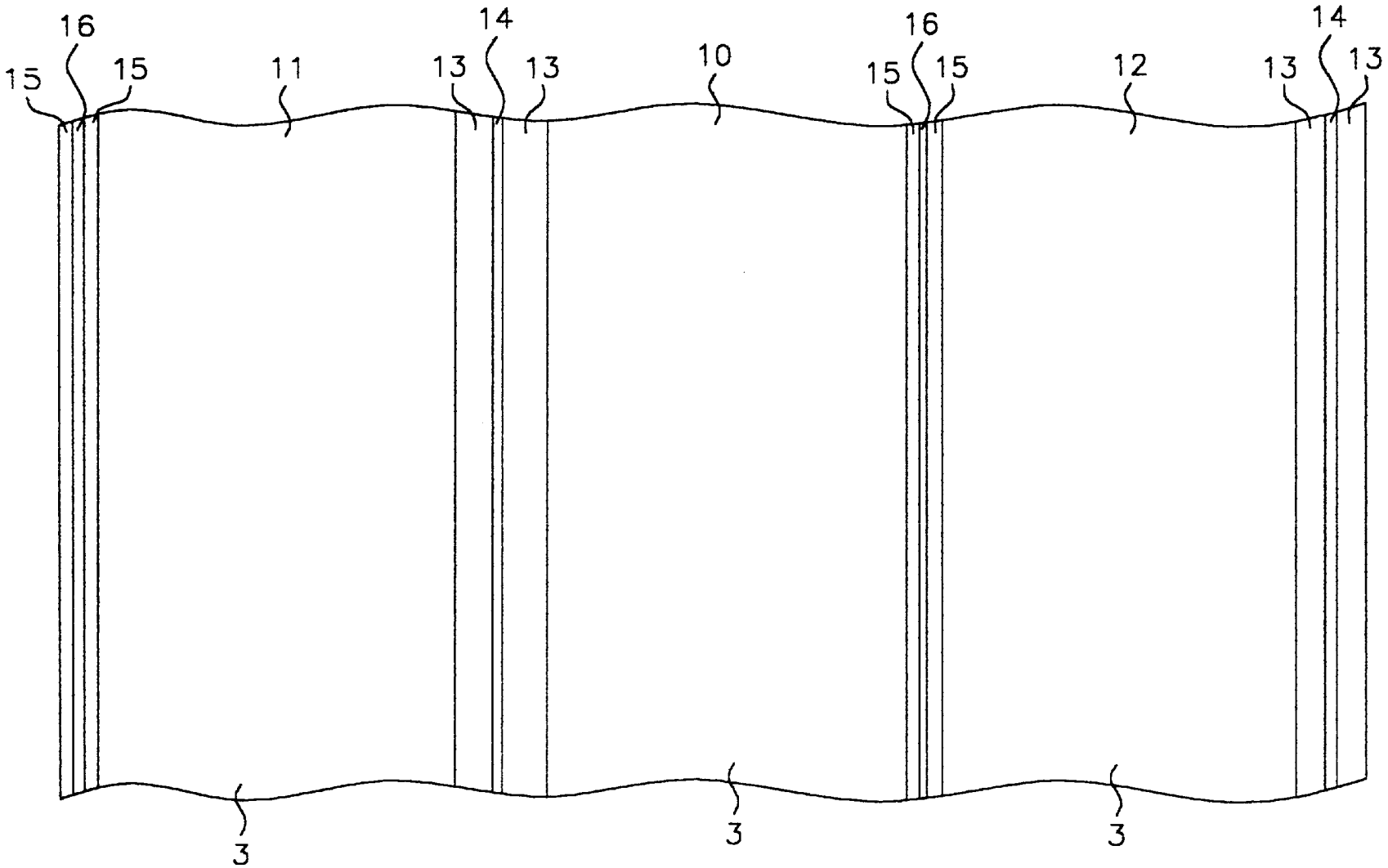
FIG. 4 is a generalized showing of the product in the form in which it comes off the knitting machine before it is pulled or torn or separated into the appropriate sized panels.

FIG. 4 shows in a generally schematic and simplified way an example of the immediate output from a knitting machine. In this example, there are three panels, a central panel 10, a left panel 11, and a right panel 12. Each one of these panels, when separated from the others, constitutes the open mesh portion of a single cubicle curtain. As the output of a knitting machine, all the panels and their selvedges are produced as one integral whole. The central panel 10 has a wide selvedge 13 on one edge and a narrow selvedge 15 on the other. The left panel 11 has a wide selvedge 13 on one edge, adjoining the wide selvedge 13 of central panel 10, and attached to a pull thread in an intermediate strip 14.

Right panel 12 has a narrow selvedge 15 at one edge, which adjoins the narrow selvedge 15 of the central panel 10, and is connected to it by an interposed pull thread in an intermediate strip 16. Each panel has a major portion which is the open mesh portion 3. In FIG. 4, like reference numerals refer to like elements. The outermost panels 11 and 12 have outermost selvedges which of course do not adjoin other elements.

FIG. 5 shows in more detail the structure and relationship of intermediate strip 16, the narrow selvedges 15, and the tear thread 17 and relief band 18 and waste strip 19. The tear thread 17, the relief band 18 and the waste strip 19 are all part of the intermediate strip 16. The entire intermediate strip 16 is discarded in the final cubicle product. It is understood in connection with FIG. 4 that narrow selvedges 13 are identical to narrow selvedges 15 and that intermediate strip 14 is identical to intermediate strip 16 and therefore, the functional and structural descriptions are identical.

The narrow selvedges 15 and the waste strip 19 are close mesh as described herein. The relief band 18 is open mesh as defined herein.

The problem solved by incorporating a relief band 18 in the knitting process is best understood in connection with FIGS. 6 and 7. FIG. 6 shows a portion of a prior art curtain panel with an open mesh section 111 and closed mesh narrow selvedge section 115. The outer edge of the narrow selvedge 115 has extreme waviness. This is due to the fact that during the finishing operation, the pins on the pin frame apparatus used to hold the fabric pull the edge out of shape. This wavy deformation appears in the finished cubicle product and is undesirable.

In FIG. 7, the narrow selvedge 15 attached to the open mesh 11 has a straight outer edge. This is because during the finishing operation, while the panel is on the pin frame apparatus and before the final separation of the intermediate strip 16 has been made, the tension of the pins is relieved by the relief band 18. The open mesh of the relief or expansion band 18 accommodates to the uneven pin tension and prevents the outer edge of the narrow selvedge becoming deformed. This results in the more desirable straight outer edge narrow selvedge as shown in FIG. 7.

The open mesh portion 3 really comprises three elements; a major portion which has the openings 9, the wide selvedge 6, and the narrow selvedge 5. Before finishing by sizing, the product is known as greige goods. Greige goods are unfinished goods, before a fabric is sized, flame retarded, and stiffened. The product is then sized with plastic resin sizing which makes it firm and flame retardant. When the product has finished being sized, it has been coated with a plastic resin. This step is performed in a conventional manner with conventional means and sizing materials.

Nylon is preferred as the material for the mesh. The material is not limited to nylon however. It may be polyester or polypropolene for example, or any known or conventional material suitable for the mesh in a cubicle curtain.

The open mesh portion of the cubicle curtain may typically have a vertical dimension of about 20 inches (about 50 centimeters). There is a final top band, which comprises a selvedge. This top band or section selvedge typically is about a 1¼ (approximately 3.2 centimeters) extension from the open mesh and forms a relatively dense band. There is also a bottom band selvedge of about ½ to which the opaque portion of the curtain is sewed.

The open mesh portion is of a construction known as "open cells". It is not a chain stitch. The preferred shape of the openings in the open mesh portion of the cubicle curtain is a six sided figure, a hexagon, with each of the openings 9 or cells having a nominal width of about ⅝ (about 1.6 centimeters) and a height of about ⅜ (about 0.8 centimeters).

In general, the area of each opening 9 is of an order of magnitude of about 1–2 centimeters squared. Exact dimensions are not critical. However, the invention is not limited to that shape of the mesh opening, but may be made for example with openings of 3, 4, or 5 sides. Also, the dimensions of the openings in the open mesh may have different dimensions than those stated above. This invention does not reside in the structure or appearance of the open cell portion; instead, the essence of this invention lies in the construction and manufacture of the edge band, that is, in the selvedge. It is understood that the exact vertical dimension of the selvedge is not critical.

It is important to note that the selvedge portion of the product is knitted. In the edge band or selvedge, the closer the knit is, the better.

If the knit in the edge band is too open, it can permit the grommets to be pulled out. A closer knit band mesh has been found to hold the grommets better. It has also been found that the use of more or a stiffer form of sizing on the material increases the reliability in holding the grommets 7. The grommets are conventional metal open circles that clamp to the fabric. They receive the hooks or hangers that suspend the cubicle curtain from the ceiling track or other support 2. The grommets are placed through the selvedge. They may typically have a hole 8 of about 3/8" (about 0.8 centimeters) and may be spaced typically on 6" (about 46 centimeters) centers. It is understood that the structure of the grommets themselves is conventional and is not in itself part of this present invention.

The band or selvedge itself at the edge of the open mesh portion of the cubicle curtain is or may technically be called a chain stitch.

It has been found that the clear or open space between threads in the selvedge is on the order of about 0.5 mm. in the most preferred embodiment. In general, the area of each open space in the selvedge is of the order of magnitude of about 0.25 millimeters squared or less. Exact dimensions are not critical. It has been found that when the knitting in the selvedge is more open, so that the clear or open space may have a diameter of the order of about 1 mm., the embodiment is less preferred, because it has been found that the grommets are not as securely held. It is understood that the nature of such knitted fabrics makes for significant variation in individual open spaces, and the above-specified dimensions are in the nature of approximate or average guides.

When the material is on the knitting machine, several panels are produced at the same time and are connected to each other by pull threads. A typical or representative example of the open mesh portion of a cubicle curtain coming off a knitting machine is shown in FIG. 4. It consists of three panels, 10, 11, and 12, each one of which will eventually form the open mesh top part portion of a different cubicle curtain. A center panel 10 has a selvedge on one edge suitable for accepting grommets 7, and a substantially narrower selvedge on the other edge suitable for being sewn or otherwise attached to the vision-resistant portion 4 of the cubicle curtain. For example, the narrow selvedge portion may have a vertical dimension of the order of ½ (about 1.3 centimeters). The wider grommet-receiving selvedge on one panel is adjacent to and attached to a similar wider selvedge on an adjacent panel. The narrow selvedge on the other edge of the panel is adjacent to and attached to a similar narrow selvedge on an adjacent panel. The panels may be separated by pulling on a preferred pull thread 14 or 16 that joins them, or alternately by tearing a tear thread that may join them.

The separating of each panel is not performed by the consumer or other purchaser of the manufactured product. The manufactured product is shipped with the panels already separated.

Several steps are saved by the fabricator which takes the mesh and uses it to produce a finished cubicle curtain. The fabricator does not have to stiffen the fabric at the top by turning it over a tape and then sewing it and then putting in the grommets. The fabricator does not have to deal with raw edges of mesh cells to turn over with the body of the opaque portion of the curtain so as to hide the raw edges. The fabricator of the completed cubicle curtain simply lays the narrow selvedge of the mesh over the turned-over top of the opaque fabric and then sews.

The tear threads are made with a monofilament. Pull threads are made with multi-filament thread. The main body of both the open mesh and the edge band are made of grouped multifilaments, which may be for example make a thread of 32 monofilaments.

It is understood that the open mesh portion 3 of the cubicle curtain, with its integral wide selvedge or edge band 6 (whose structure and manufacture is the subject of this invention), is sewn or otherwise fastened to the vision-resistant main portion 4 of the cubicle curtain. The structure of the main portion is not in itself a subject of this present invention.

In pulling or tearing apart the originally knitted material to make the useful panels, there is some wastage of the close knit portion. This part is thrown away. It is called "waste selvedge".

In the present invention, both wide the grommet-receiving selvedge, and the narrow selvedge affixed to the vision-resistant portion, are knitted, not woven. Weaving involves an over and under connection of threads, with a warp and woof. Knitting, on the other hand, involves a twisting and looping interconnection. The production of knitted fabrics by knitting machines is conventional, as is the exact description and definition of a knitted fabric. It is critical to the present invention that the selvedges be knitted.

I claim:

1. A cubicle curtain having a main lower portion of vision-resistant fabric, and an upper open mesh portion, said open mesh having a major portion with openings, said open mesh major portion having an integral knitted upper wide selvedge on one edge thereof, said knitted wide selvedge having a substantially finer mesh than said open mesh major portion, and said open mesh major portion having an integral narrow knitted selvedge on an other edge thereof, said narrow selvedge having a substantially finer mesh than said open mesh major portion, and said narrow selvedge having a straight outer edge.

2. A cubical curtain as set forth in claim 1 wherein said open mesh major portion openings each have an area of an order of magnitude of about 1–2 centimeters squared.

3. A cubical curtain as set forth in claim 1 wherein the mesh size of the said wide selvedge and said narrow selvedge provides a plurality of openings between the threads thereof of the order of magnitude of about 0.25 millimeters squared.

4. A cubical curtain as set forth in claim 1 wherein the width of said wide selvedge is between about 1–2 inches.

5. A cubical curtain as set forth in claim 1 wherein said openings in said open mesh major portion have a generally hexagonal shape.

6. A cubical curtain as set forth in claim 1 wherein said openings in said open mesh major portion have a generally rectangular shape.

7. A cubical curtain as set forth in claim 1 wherein said open mesh is knitted of synthetic threads.

8. A cubical curtain as set forth in claim 7 wherein said monofilaments are nylon.

9. A cubical curtain as set forth in claim 8 wherein said open mesh is coated with a plastic resin sizing.

10. An open mesh, adapted for use as the upper portion of a cubicle curtain, said open mesh having a major portion with openings, said open mesh major portion having an integral knitted upper wide selvedge on one edge thereof, said knitted wide selvedge having a substantially finer mesh than said open mesh major portion, and said open mesh major portion having an integral narrow knitted selvedge on an opposed edge thereof, said narrow selvedge having a substantially finer mesh than said open mesh major portion, and said narrow selvedge having a straight outer edge.

11. An open mesh as set forth in claim 10 wherein said open mesh major portion openings each have an area of an order of magnitude of about 1–2 centimeters squared.

12. An open mesh as set forth in claim 10 wherein the mesh size of the said wide selvedge and said narrow selvedge provides a plurality of openings between the threads thereof of the order of magnitude of about 0.25 millimeters squared.

13. An open mesh as set forth in claim 10 wherein the width of said wide selvedge is between about 1–2 inches.

14. An open mesh as set forth in claim 10 wherein said openings in said open mesh major portion have a generally hexagonal shape.

15. An open mesh as set forth in claim 10 wherein said openings in said open mesh major portion have a generally rectangular shape.

16. An open mesh as set forth in claim 10 wherein said open mesh is knitted of synthetic threads.

17. An integrally knitted plurality of panels in adjoining side-by side relationship, each said panel being an open mesh, adapted for use as the upper portion of a cubicle curtain, said open mesh having a major portion with openings, said open mesh major portion having an integral knitted upper wide selvedge on one edge thereof, said knitted wide selvedge having a substantially finer mesh than said open mesh major portion, and said open mesh major portion having an integral narrow knitted selvedge on an opposed edge thereof, said narrow selvedge having a substantially finer mesh than said open mesh major portion, an intermediate strip between said adjoining panels, a said narrow selvedge on each side of said intermediate strip, said intermediate strip comprising a tear thread, a waste strip and an open mesh relief band.

18. The method of making the open mesh portion of a cubicle curtain comprising the steps of integrally knitting a plurality of panels in adjoining side-by side relationship, each said panel being an open mesh, said open mesh having a major portion with openings, said open mesh major portion having an integral knitted upper wide selvedge on one edge thereof, said knitted wide selvedge having a substantially finer mesh than said open mesh major portion, and said open mesh major portion having an integral narrow knitted selvedge on an opposed edge thereof, said narrow selvedge having a substantially finer mesh than said open mesh major portion, with an intermediate strip between said adjoining panels, a said narrow selvedge on each side of said intermediate strip, said intermediate strip comprising a tear thread, a waste strip and an open mesh relief band, mounting said panels on a pin frame for finishing, then making a separation of one of said narrow selvedges at said tear thread, and making a final separation of said intermediate strip from said other said narrow selvedge.

* * * * *